US012663207B2

(12) United States Patent
Song et al.

(10) Patent No.: US 12,663,207 B2
(45) Date of Patent: Jun. 23, 2026

(54) REFRIGERATOR AND CONTROL METHOD THEREOF

(71) Applicant: LG ELECTRONICS INC., Seoul (KR)

(72) Inventors: Youngseung Song, Seoul (KR); Min Hyuk Park, Seoul (KR); Sangbok Choi, Seoul (KR); Yun Su Cho, Seoul (KR)

(73) Assignee: LG ELECTRONICS, INC., Seoul (KR)

( * ) Notice: Subject to any disclaimer, the term of this patent is extended or adjusted under 35 U.S.C. 154(b) by 240 days.

(21) Appl. No.: 18/266,768

(22) PCT Filed: Nov. 12, 2021

(86) PCT No.: PCT/KR2021/016574
§ 371 (c)(1),
(2) Date: Jun. 12, 2023

(87) PCT Pub. No.: WO2022/131562
PCT Pub. Date: Jun. 23, 2022

(65) Prior Publication Data

US 2024/0133621 A1 Apr. 25, 2024
US 2024/0230215 A9 Jul. 11, 2024

(30) Foreign Application Priority Data

Dec. 14, 2020 (KR) ..... 10-2020-0174461

(51) Int. Cl.
*F25D 29/00* (2006.01)

(52) U.S. Cl.
CPC ..... *F25D 29/00* (2013.01); *F25D 2500/04* (2013.01); *F25D 2600/02* (2013.01); *F25D 2700/02* (2013.01); *F25D 2700/121* (2013.01)

(58) Field of Classification Search
CPC .. F25D 29/00; F25D 2500/04; F25D 2600/02; F25D 2700/02; F25D 2700/121
See application file for complete search history.

(56) References Cited

U.S. PATENT DOCUMENTS

2016/0238268 A1* 8/2016 Nishimura ..... F24F 11/65
2017/0205104 A1* 7/2017 Yoshitani ..... F24F 11/30
(Continued)

FOREIGN PATENT DOCUMENTS

CN 101004284 A * 7/2007
JP S5997444 A * 6/1984
(Continued)

OTHER PUBLICATIONS

Tsuno, Air Conditioner, Jun. 20, 2016, JP2016109372A, Whole Document (Year: 2016).*
(Continued)

*Primary Examiner* — Larry L Furdge
(74) *Attorney, Agent, or Firm* — Bryan Cave Leighton Paisner LLP

(57) ABSTRACT

According to the present disclosure, after a load operation is performed by satisfying a start condition of the load operation, the load operation is terminated when a compartment temperature of a storage compartment satisfies a termination condition when a door is opened or when a temperature change in the storage compartment satisfies the termination condition. Accordingly, excessive power consumption during the load operation may be prevented, and thus power consumption may be improved.

7 Claims, 8 Drawing Sheets

(56) References Cited

U.S. PATENT DOCUMENTS

| | | | | |
|---|---|---|---|---|
| 2019/0264975 | A1* | 8/2019 | Kim | F25D 23/02 |
| 2020/0149798 | A1* | 5/2020 | Ahn | F25D 29/00 |

FOREIGN PATENT DOCUMENTS

| | | | | |
|---|---|---|---|---|
| JP | H06101910 | A | * | 4/1994 |
| JP | 2016109372 | A | * | 6/2016 |
| WO | WO2020054252 | A1 | * | 3/2020 |

OTHER PUBLICATIONS

Nishimura et al., Cooling Device, Mar. 19, 2020, WO2020054252A1, Whole Document (Year: 2020).*
Higasa, Temperature Control Device for Air Conditioner, Jun. 5, 1984, JPS5997444A, Whole Document (Year: 1984).*
Je Song et al., Control Method of an Operating an Air-Conditioner, Jul. 25, 2007, CN101004284A, Whole Document (Year: 2007).*
Shimoide et al., Temperature Regulator of Refrigerator, Apr. 12, 1994, JPH06101910A, Whole Document (Year: 1994).*

* cited by examiner

【Figure 1】
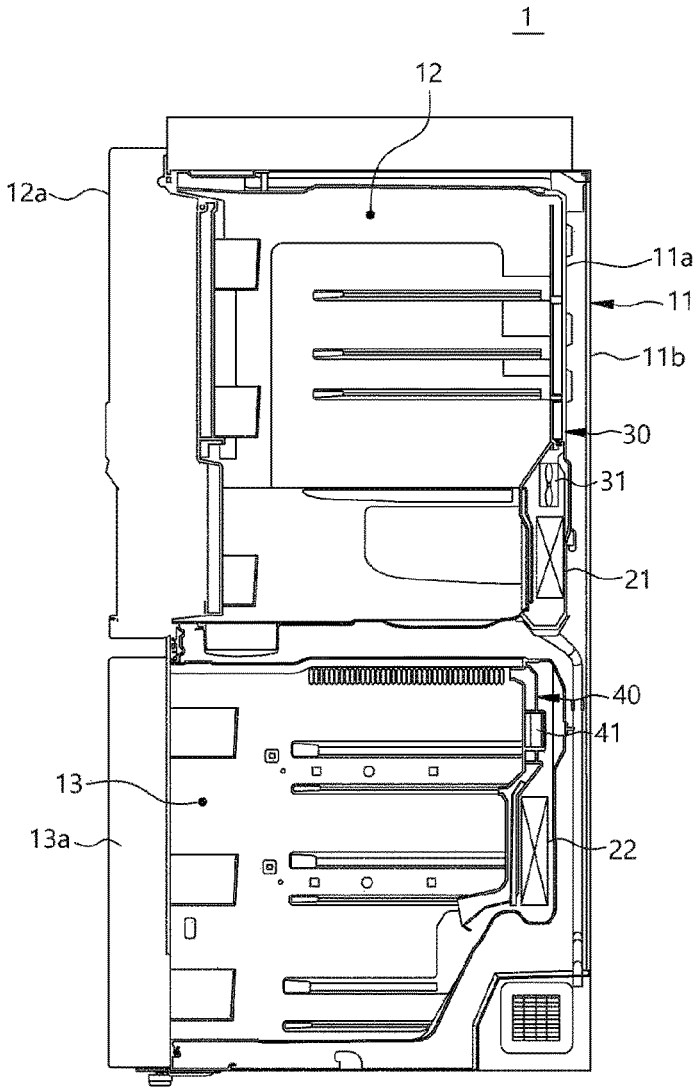

【Figure 2】
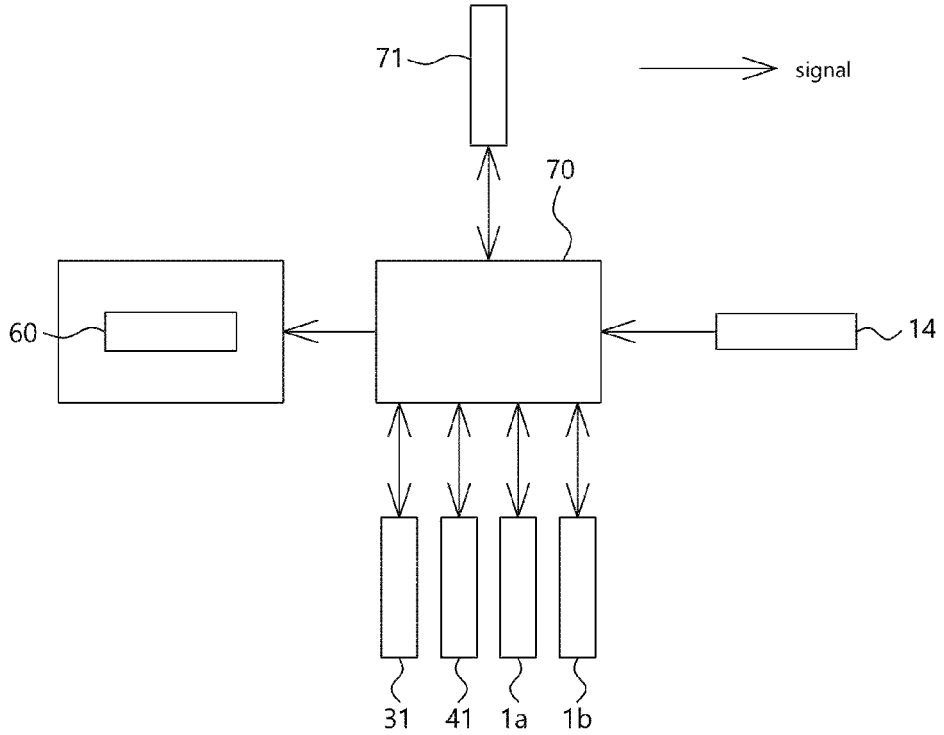
【Figure 3】
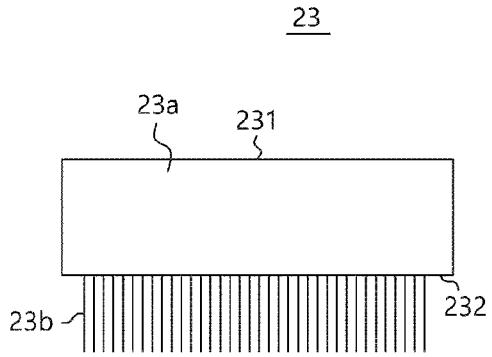

【Figure 4】
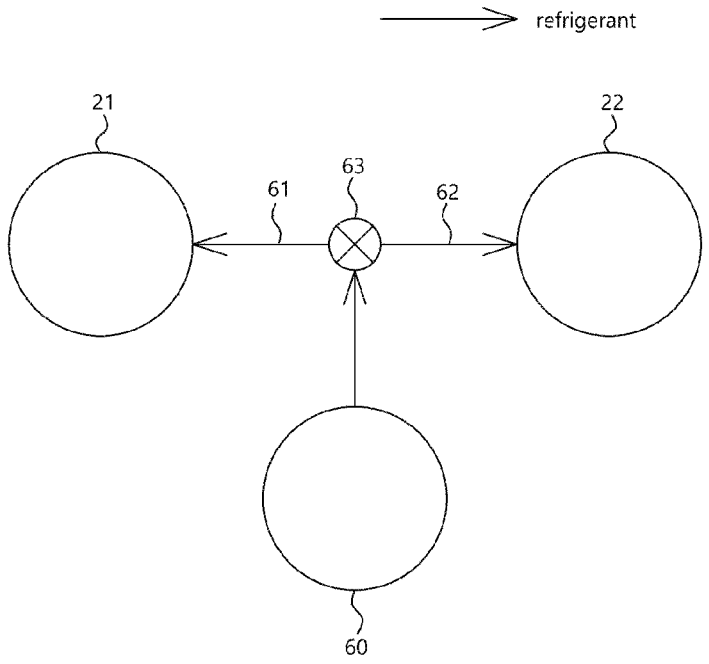
【Figure 5】
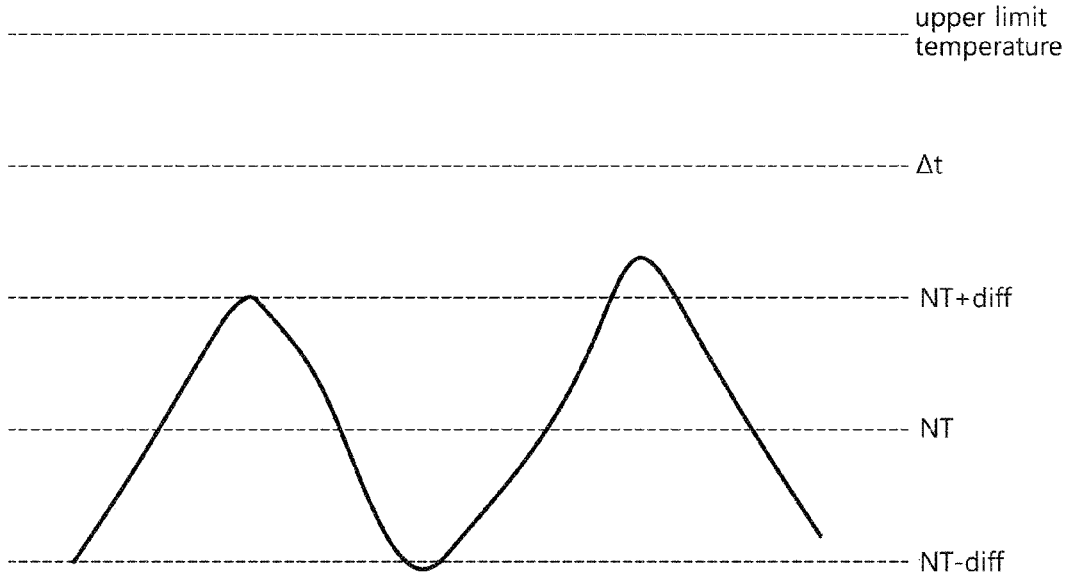

【Figure 6】
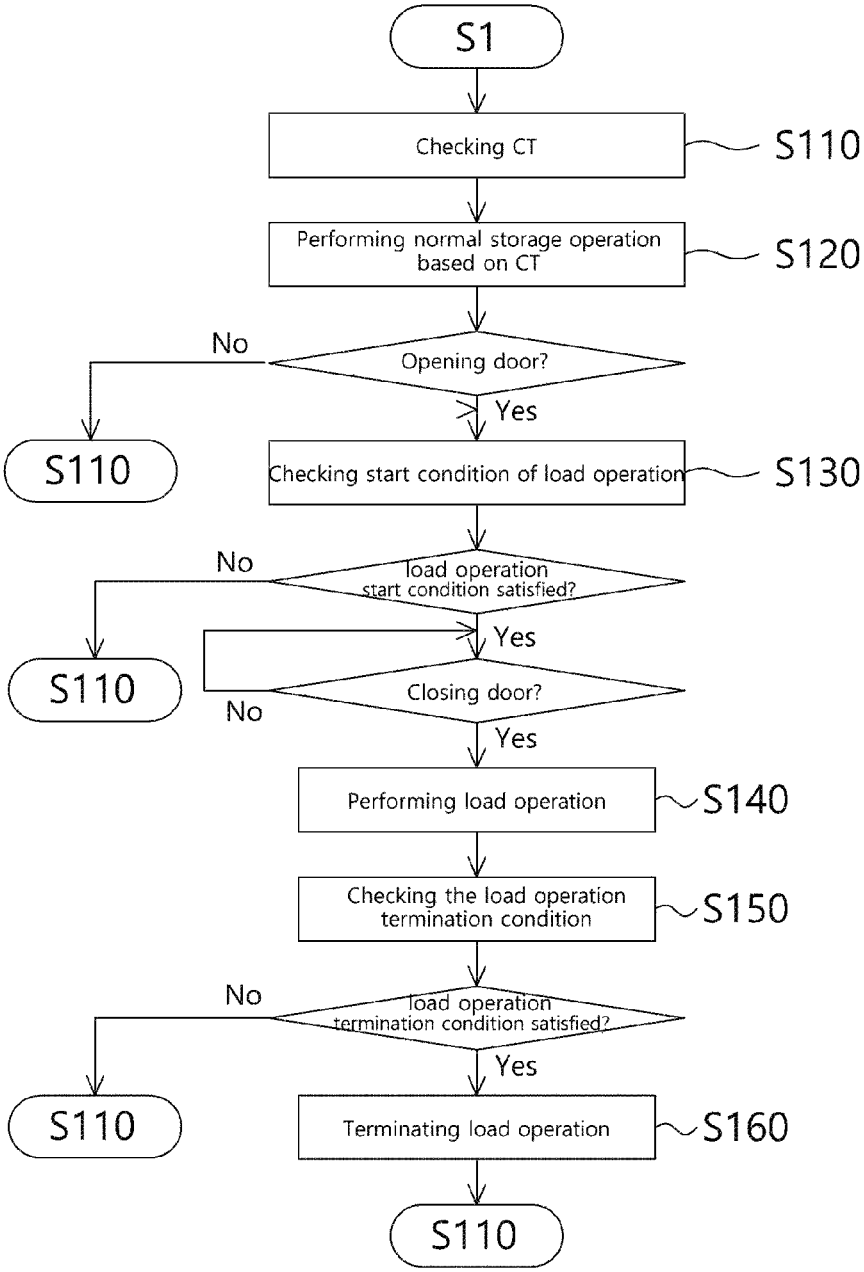

【Figure 7】
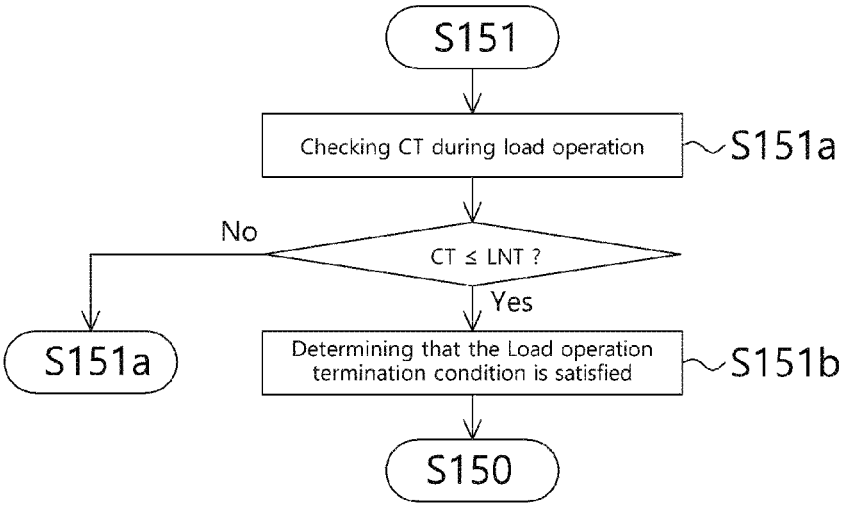
【Figure 8】
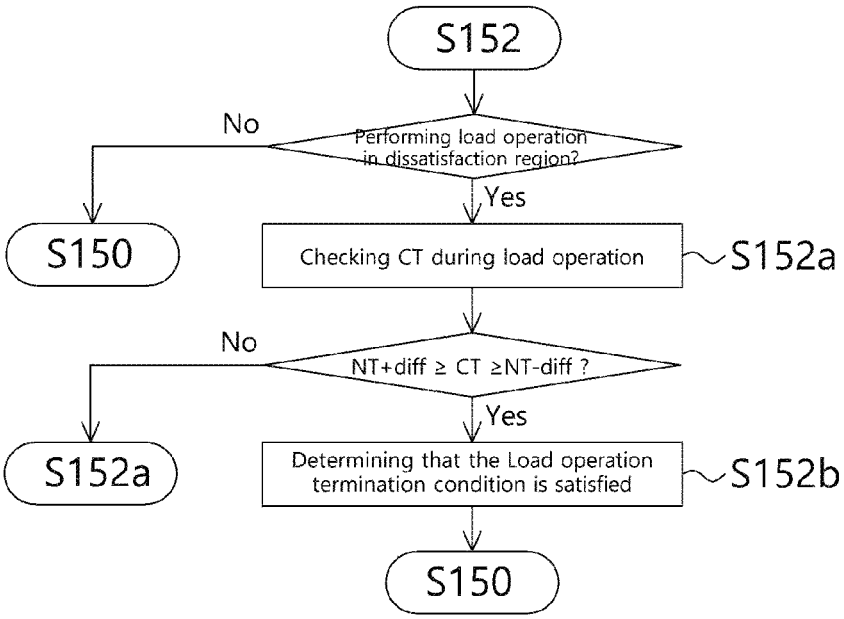

【Figure 9】
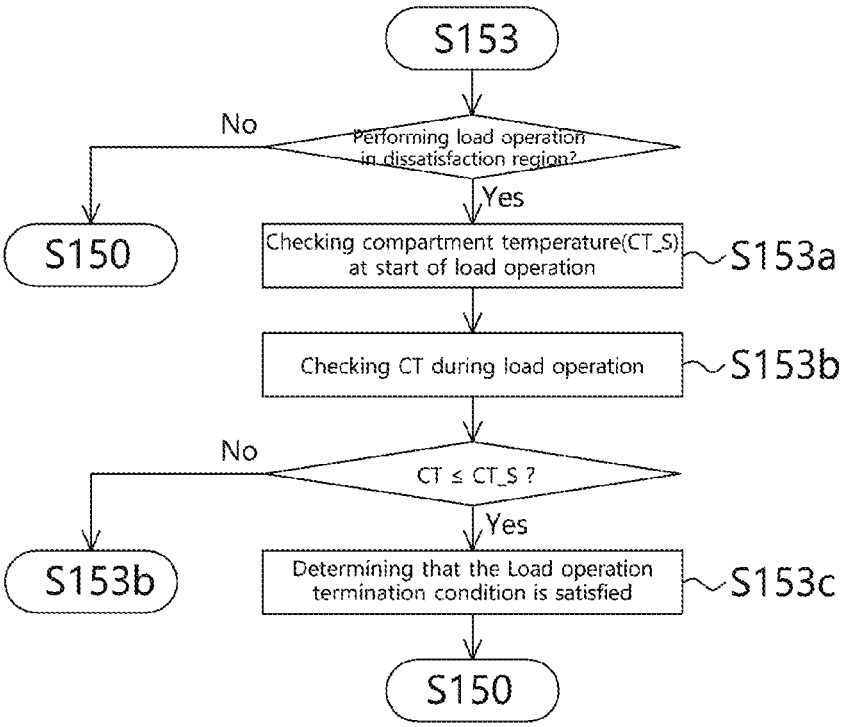
【Figure 10】
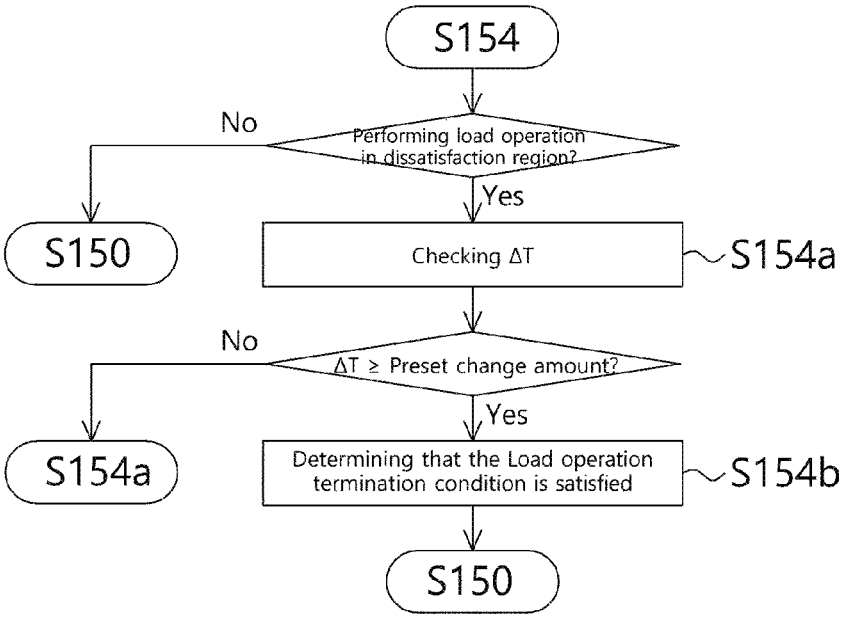

【Figure 11】
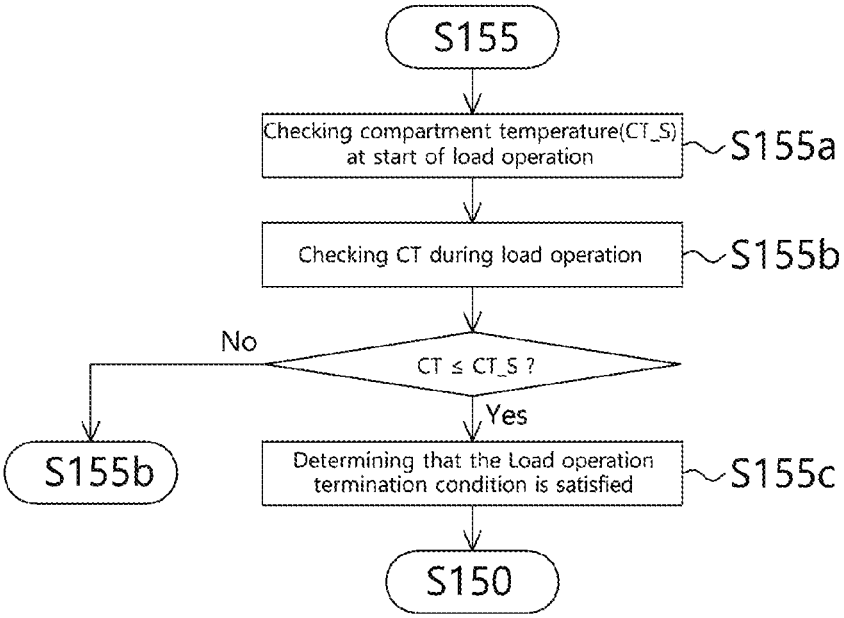

【Figure 12】
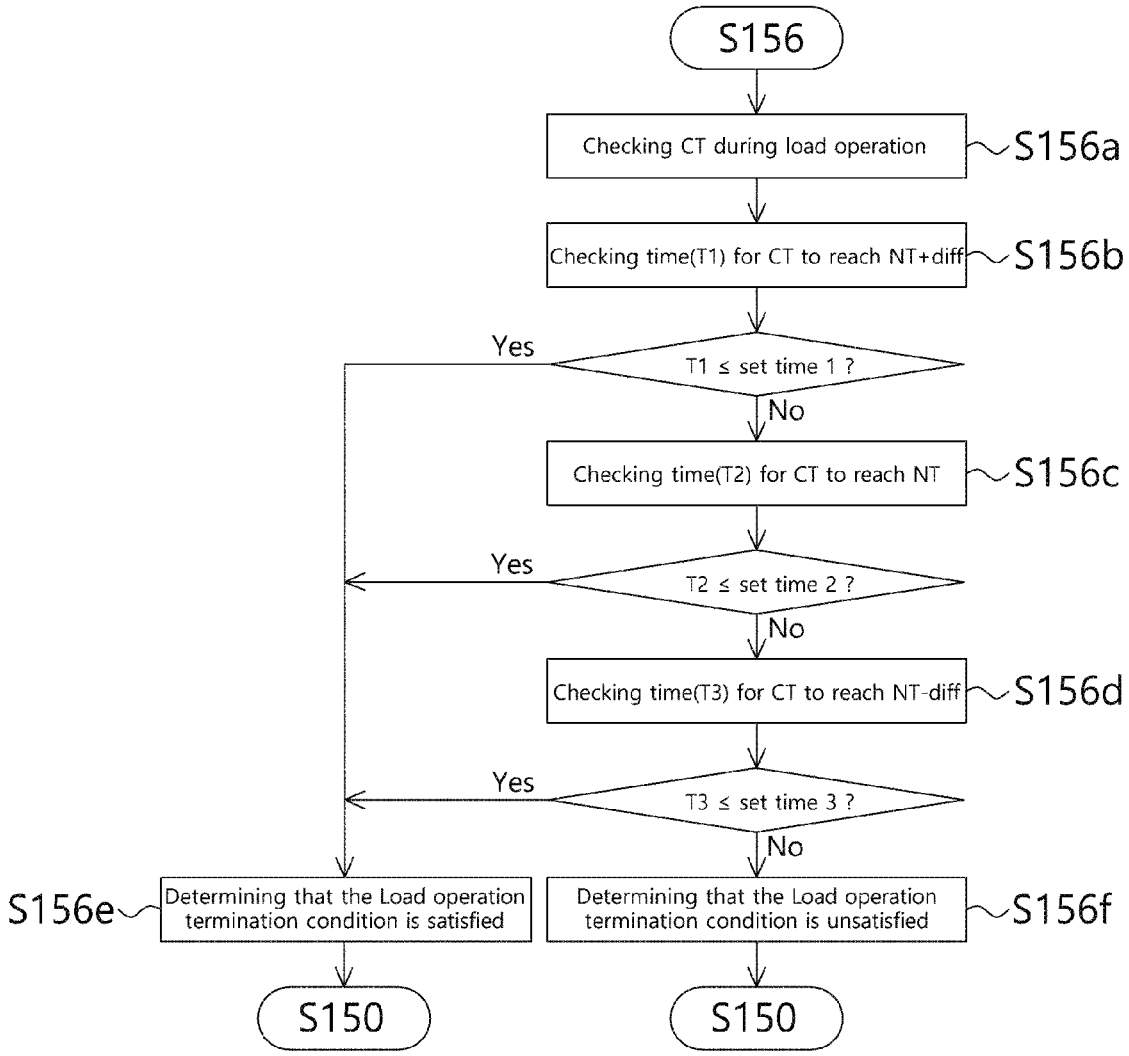

REFRIGERATOR AND CONTROL METHOD THEREOF

CROSS REFERENCE TO RELATED APPLICATION

The present application claims priority to Korean Patent Application No. 10-2020-0174461 filed on Dec. 14, 2020, the entire contents of which are incorporated herein for all purposes by this reference.

TECHNICAL FIELD

The present disclosure relates to a refrigerator and control method thereof according to a new method in which power consumption may be improved by efficiently terminating a load operation performed to solve an excessive temperature rise in a refrigerator caused by opening a door.

BACKGROUND ART

In general, a refrigerator is a device that may store objects in a storage space for a long time or while maintaining a constant temperature by using cold air.

The refrigerator includes a refrigeration system including a compressor and an evaporator to generate and circulate cold air.

A temperature control for a storage compartment operates the compressor to supply cold air into the storage compartment when the temperature rises further than an upper limit notch temperature (NT+diff) based on a set notch temperature (NT: Notch) of the storage compartment, and when the temperature decreases further than a lower limit notch temperature (NT−diff) based on the set notch temperature (NT), the operation of the compressor is stopped to block the cold air supplied to the storage compartment.

Meanwhile, the temperature in the storage compartment may rise even though the refrigeration system is not broken during a normal storage operation for the storage compartment.

It may be a case when hot food is stored in the storage compartment or when an indoor air outside the refrigerator is introduced into the refrigerator as a door of the refrigerator is opened for a long time.

In the prior arts, when a door is opened, a load operation is performed with a higher output (compressor output) than the normal operation, such that an inside of the storage compartment is quickly reached to a normal storage temperature.

The load operation has an advantage of protecting food in the storage compartment by quickly stabilizing the temperature in the storage compartment, but also has a disadvantage of lowering power consumption.

In relation to the load operation, various methods are provided, such as Korean Patent No. 10-2017-0087440, Korean Patent No. 10-2020-0105183, and Korean Patent No. 10-2020-0087049.

However, in the prior arts, when measuring the power consumption of a refrigerator, it is measured only by performing the normal storage operation without opening and closing the door, so efforts for efficient load operation are insufficient.

That is, since the conventional measurement of power consumption is performed without considering the consumer's real life (the act of opening and closing the door frequently), there is a complaint that the conventional power consumption measurement is different from the power consumption that the consumer actually experiences while using a refrigerator.

Of course, there are efforts to efficiently execute the load operation so as to prevent a degradation in power consumption, as in Korean Patent No. 10-2018-0055242.

That is, when the door is opened, the load operation is performed only when a certain condition (for example, the temperature rises by 2° C. or more within 5 minutes after the door is opened) is satisfied, so that power consumption considering actual use may be improved.

However, since the load operation of the prior art does not take into account the compartment temperature of the storage compartment at the time when the door is opened, the load operation of the prior art does not sufficiently satisfy the actual use situation.

For example, in the prior art, when a temperature at the time of opening the door is between a set notch temperature (NT) and an upper limit notch temperature (NT+diff), or is higher than the upper limit notch temperature (NT+diff), food deterioration may occur by entering a dissatisfaction region exceeding the upper limit notch temperature (NT+diff), even if the temperature does not exceed 2° C. within 5 minutes. That is, the prior art has a disadvantage in that food is not safely protected because the load operation is performed only when a temperature change of 2° C. occurs even when the temperature of the storage compartment is close to the dissatisfaction region.

In the prior art, when a temperature at the time of opening the door is the temperature between the set notch temperature (NT) and the lower limit notch temperature (NT−diff), or lower than the lower limit notch temperature (NT−diff), even if the temperature rises by more than 2° C. within 5 minutes, the temperature of the storage compartment still satisfies the set notch temperature (NT). Even in this case, the load operation is performed, resulting in increasing power consumption.

In addition, the conventional load operation is controlled to be performed for a predetermined time with a maximum load of the refrigerator. In other words, in the case of the load operation, a compressor is operated at the maximum load and a cooling fan is operated at the maximum speed so that the temperature in the storage compartment may be stabilized (maintained within the notch temperature range) as soon as possible.

However, in the conventional method described above, overcooling may occur due to the continuous operation of the load operation at the maximum cooling power for a predetermined time or up to a predetermined temperature even though the temperature in the storage compartment reaches a satisfaction region.

In particular, since the predetermined temperature is lower than the lower limit notch temperature (NT−diff), even if the load operation is terminated after reaching the predetermined temperature, the temperature drops to the overcooling range frequently occurs due to the temperature inertia. As a result, power consumption also increases and power consumption efficiency is inevitably decreased.

DISCLOSURE

Technical Problem

The present disclosure is proposed to solve various problems according to the prior art described above. An objective of the present disclosure is to provide a refrigerator and a control method thereof in which an operation condition and termination condition of a load operation which is performed in order to solve an excessive temperature rise in the refrigerator caused by opening a door of the refrigerator are improved and the efficient load operation is performed.

Another objective of the present disclosure is to provide a refrigerator and a control method thereof capable of preventing overcooling of a storage compartment by allowing the load operation to be terminated in consideration of a set lowest temperature which may be predetermined of the corresponding storage compartment.

Another objective of the present disclosure is to provide a refrigerator and a control method thereof capable of preventing overcooling of a storage compartment by terminating the load operation in consideration of a temperature change in the storage compartment lowered due to the load operation.

Technical Solution

According to the refrigerator and the control method thereof the present disclosure for achieving the above objects, after a load operation is performed, when a temperature of a storage compartment reaches a set lowest temperature (LNT) which may be predetermined, the load operation is terminated.

According to the refrigerator and the control method thereof the present disclosure, the set lowest temperature (LNT) which may be predetermined may be lower than a lower limit notch temperature (NT−diff) set based on a set notch temperature (NT).

According to the refrigerator and the control method thereof the present disclosure, if the load operation starts when the temperature in the storage compartment is in a dissatisfaction region, it may be determined that a termination condition of the load operation is satisfied when the temperature in the storage compartment is in a satisfaction region.

According to the refrigerator and the control method thereof the present disclosure, if the load operation starts when the temperature in the storage compartment is in the dissatisfaction region, it may be determined that the termination condition of the load operation is satisfied when the temperature in the storage compartment (CT; Compartment Temperature) is lower than a start temperature of the load operation.

According to the refrigerator and the control method thereof the present disclosure, if the load operation starts when the temperature in the storage compartment is in a dissatisfaction region, the termination condition of the load operation may be determined differently according to a temperature change amount (ΔT) per unit time in the storage compartment.

According to the refrigerator and the control method thereof the present disclosure, when the door is opened while the load operation is being performed, the load operation may be controlled to be performed with a maximum cooling power after the door is closed.

According to the refrigerator and the control method thereof the present disclosure, when an input condition of a defrosting operation is satisfied while the load operation is being performed, a pre-defrosting operation may be preferentially performed.

According to the refrigerator and the control method thereof the present disclosure, when a cooling power control means is operated at a maximum load and the temperature in the storage compartment (CT) reaches a defrosting performance temperature lower than the lower limit notch temperature (NT−diff), the pre-defrosting operation may be terminated.

According to the refrigerator and the control method thereof the present disclosure, the defrosting operation may be performed after the pre-defrosting operation is terminated.

According to the refrigerator and the control method thereof the present disclosure, after the defrosting operation is terminated, the cooling power control means is operated at the maximum load, and when the temperature in the storage compartment (CT) reaches a temperature lower than the lower limit notch temperature (NT−diff), the load operation may be terminated.

According to the refrigerator and the control method thereof the present disclosure, after the load operation is performed, when the temperature in the storage compartment (CT) falls below the temperature when the load operation starts, the load operation may be terminated.

According to the refrigerator and the control method thereof the present disclosure, when a set elapsed time elapses while the load operation is performed, the temperature in the storage compartment (CT) for terminating the load operation may be checked.

According to the refrigerator and the control method thereof the present disclosure, a start condition of the load operation may be determined to be satisfied when the temperature of the storage compartment rises above an input condition temperature (Δt) for a set time.

According to the refrigerator and the control method thereof the present disclosure, the elapsed time set for the termination of the load operation may be shorter than a time set for the start condition of the load operation.

According to the refrigerator and the control method thereof the present disclosure, when it is confirmed that a time taken for the temperature in the storage compartment (CT) to reach any one of a plurality of set temperatures is shorter than a preset arrival time for each corresponding temperature, the load operation may be terminated.

According to the refrigerator and the control method thereof the present disclosure, when the time for the temperature in the storage compartment (CT) to reach any one of the plurality of set temperatures is shorter than the preset arrival time for each corresponding temperature, the termination condition of the load operation may be determined to be satisfied.

According to the refrigerator and the control method thereof the present disclosure, the plurality of set temperatures may include any one of the set notch temperature (NT), an upper limit notch temperature (NT+diff) higher than the set notch temperature (NT), and the lower limit notch temperature (NT−diff) lower than the set notch temperature (NT).

According to the refrigerator and the control method thereof the present disclosure, a controller measures the temperature change amount (ΔT) per unit time of the temperature in the storage compartment (CT) during the load operation, and controls the termination time of the load operation to be varied according to the temperature change amount (ΔT) per unit time.

According to the refrigerator and the control method thereof the present disclosure, the temperature change amount (ΔT) per unit time (ΔT) may be measured when the temperature in the storage compartment (CT) reaches the upper limit notch temperature (NT+diff) set based on the set notch temperature (NT).

According to the refrigerator and the control method thereof the present disclosure, as the temperature change amount (ΔT) per unit time becomes greater, the termination time of the load operation may be shortened.

Advantageous Effect

As described above, in a refrigerator and a control method thereof the present disclosure, during a load operation, when a temperature in a first storage compartment 12 reaches a set lowest temperature (LNT), the load operation is terminated. Therefore, the present disclosure has an effect of preventing stored items from being unwantedly frozen due to excessive cooling.

In addition, in the refrigerator and control method thereof of the present disclosure, when the load operation starts in the temperature dissatisfaction region in the storage compartment, the load operation is terminated when the temperature in the storage compartment belongs to a satisfaction region, thereby reducing power consumption for the load operation.

In addition, in the refrigerator and control method thereof of the present disclosure, when the load operation starts in the temperature dissatisfaction region in the storage compartment, the load operation is terminated when the temperature in the storage compartment (CT) is lower than the start temperature of the load operation, thereby reducing power consumption for the load operation.

In addition, in the refrigerator and control method thereof of the present disclosure, after the load operation is performed, when the temperature in the storage compartment (CT) falls below the temperature when the load operation starts, the load operation is terminated, thereby reducing power consumption for the load operation.

In addition, in the refrigerator and control method thereof of the present disclosure, since the load operation is terminated when a time for the temperature in the storage compartment (CT) to reach any one of a plurality of set temperatures during the load operation is shorter than a preset arrival time for each corresponding temperature, the load operation due to an opening of a door may be accurately performed and power consumption for the load operation may be reduced.

In addition, in the refrigerator and control method thereof of the present disclosure, during the load operation, as a temperature change amount (ΔT) per unit time of the temperature in the storage compartment (CT) becomes greater, the termination time of the load operation is controlled to be shortened, such that power consumption for the load operation may be reduced.

DESCRIPTION OF DRAWINGS

FIG. 1 is a state diagram illustrating an internal structure of a refrigerator according to an embodiment of the present disclosure.

FIG. 2 is a block diagram schematically illustrating a structure for a load operation of the refrigerator according to the embodiment of the present disclosure.

FIG. 3 is a state diagram schematically illustrating the structure of a thermoelectric module according to the embodiment of the present disclosure.

FIG. 4 is a block diagram schematically illustrating a refrigeration cycle of the refrigerator according to the embodiment of the present disclosure.

FIG. 5 is a diagram schematically illustrating an operation state performed according to an operation base value based on a user setting notch temperature for a storage compartment of the refrigerator according to the embodiment of the present disclosure.

FIG. 6 is a flowchart illustrating a control method of the refrigerator according to the embodiment of the present disclosure.

FIG. 7 is a flowchart illustrating an example of a control process according to a termination condition of the load operation in the control method of the refrigerator according to the embodiment of the present disclosure.

FIG. 8 is a flowchart illustrating another example of a control process according to the termination condition of the load operation in the control method of the refrigerator according to the embodiment of the present disclosure.

FIG. 9 is a flowchart illustrating another example of a control process according to the termination condition of the load operation in the control method of the refrigerator according to the embodiment of the present disclosure.

FIG. 10 is a flowchart illustrating another example of a control process by the termination condition of the load operation in the control method of the refrigerator according to the embodiment of the present disclosure.

FIG. 11 is a flowchart illustrating another example of a control process by the termination condition of the load operation in the control method of the refrigerator according to the embodiment of the present disclosure.

FIG. 12 is a flowchart illustrating another example of a control process by the termination condition of the load operation in the control method of the refrigerator according to the embodiment of the present disclosure.

BEST MODE

According to the present disclosure, a load operation may be controlled differently in accordance with a compartment temperature (CT) in the storage compartment, thereby reducing power consumption and improving power efficiency.

That is, according to the present disclosure, power consumption may be reduced by enabling the load operation to be performed with a variable load instead of being performed with only a maximum load.

Preferred embodiments of a refrigerator and a control method thereof according to the present disclosure will be described with reference to FIGS. 1 to 12.

The FIG. 1 is a state diagram for explaining an internal structure of the refrigerator according to an embodiment of the present disclosure, and FIG. 2 is a block diagram schematically illustrating a structure for load operation of the refrigerator according to the embodiment of the present disclosure.

As illustrated in the drawings, according to the embodiment of the present disclosure, a refrigerator may include a casing 11.

The casing 11 includes an inner casing 11*a* forming an internal wall surface of the refrigerator 1 and an outer casing 11*b* forming the exterior. A storage compartment is provided at the casing 11 to store stored items.

Only one storage compartment may be provided, or two or more storage compartments may be provided. In an embodiment of the present disclosure, for example, two storage compartments for storing the stored items in different temperature regions are included.

The storage compartment may include a first storage compartment 12 maintained at a first set notch temperature (NT: Notch Temperature).

The first set notch temperature (NT) may be a temperature at which a stored item is not frozen, but may be in a lower temperature range than an external temperature (room temperature) outside the refrigerator 1.

For example, the first set notch temperature (NT) may be set to equal to or less than 32° C. or greater than 0° C. in the refrigerator (compartment temperature CT) (temperature in the first storage compartment). Of course, the first set notch temperature (NT) may be set higher than 32° C., or equal to or lower than 0° C., as necessary (e.g., depending on the room temperature or the type of storage items).

In particular, the first set notch temperature (NT) may be a compartment temperature (CT) of the first storage compartment 12 preset by a user. However, when the user does not preset the first set notch temperature (NT), a predetermined temperature may be used as the first set notch temperature (NT).

In addition, the first storage compartment 12 is subjected to a normal storage operation at a first operation base value (NT±diff) to maintain the first set notch temperature (NT).

The first operation base value (NT±diff) is a temperature range value of a satisfaction region including a first lower limit notch temperature (NT−diff) and a first upper limit notch temperature (NT+diff).

That is, when the compartment temperature (CT) of the first storage compartment 12 reaches the first lower limit notch temperature (NT−diff) based on the first set notch temperature (NT), the operation for supplying cold air is stopped. On the other hand, when the compartment temperature (CT) rises based on the first set notch temperature (NT), the operation for supplying cold air resumes before reaching the first upper limit notch temperature (NT+diff).

As such, in the first storage compartment 12, the normal storage operation is performed while supplying or stopping the supply of cold air in consideration of the first operation base value (NT±diff) of the first storage compartment 12 based on the first set notch temperature (NT).

The first set notch temperature (NT) and the first operation base value (NT±diff) are as shown in FIG. 3.

In addition, the refrigerator may include a second storage compartment 13 maintained at a second set notch temperature (NT2).

The second set notch temperature (NT2) may be lower than the first set notch temperature (NT). In this case, the second set notch temperature (NT2) may be preset by the user, and when the user does not preset it, a predetermined temperature may be used.

The second set notch temperature (NT2) may be a temperature sufficient to freeze the storage. For example, the second set notch temperature (NT2) may be set to a temperature of equal to or lower than 0° C. or equal to or higher than −24° C.

Of course, the second set notch temperature (NT2) may be set higher than 0° C., or equal to or lower than −24° C., as necessary (e.g., depending on the room temperature or type of storage items).

In particular, the second set notch temperature (NT2) may be the temperature of the second storage compartment 13 set by the user, and when the user does not preset the second set notch temperature (NT2), a predetermined temperature may be used as the second set notch temperature (NT2).

In addition, the second storage compartment 13 may be operated at a second operation base value (NT2±diff2) to maintain the second set notch temperature (NT2).

The second operation base value (NT2±diff2) is a temperature range value of a satisfaction region including a second lower limit notch temperature (NT2-diff2) and a second upper limit notch temperature (NT2+diff2).

That is, when the temperature of the second storage compartment 13 reaches the second lower limit notch temperature (NT2-diff2) based on the second set notch temperature (NT2), the operation for supplying cold air may be stopped. On the other hand, when the temperature of the storage compartment rises based on the second set notch temperature (NT2), the operation for supplying cold air resumes before reaching the second upper limit notch temperature (NT2+diff2).

As such, in the second storage compartment 13, the cold air is supplied or stopped in consideration of the second operation base value (NT2±diff2) for the second storage compartment 13 based on the second set notch temperature (NT2).

In particular, the first operation base value (NT±diff) may be set to have a smaller range between the upper limit notch temperature (NT+diff) and the lower limit notch temperature (NT−diff) than the second operation base value (NT2±diff2).

For example, the first lower limit notch temperature (NT−diff) and the first upper limit notch temperature (NT+diff) of the first operation base value (NT±diff) may be set to ±2.0° C., and the second lower limit notch temperature (NT2−diff2) and the second upper limit notch temperature (NT2+diff2) of the second operation base value (NT2±diff2) may be set to ±1.5° C.

Meanwhile, each storage compartment 12 and 13 is configured such that the compartment temperature of the storage compartment is maintained while a fluid is circulated.

The fluid may be air. In the following description, the fluid circulating through the storage compartment 12 and 13 is air. Of course, the fluid may be a gas other than air.

The external temperature of the storage compartment 12 and 13 (room temperature) may be measured by a first temperature sensor 1*a*, and the compartment temperature (CT) of the first storage compartment may be measured by a second temperature sensor 1*b* (see FIG. 9 attached).

The first temperature sensor 1*a* and the second temperature sensor 1*b* may be performed separately. Of course, the room temperature and the compartment temperature (CT) may be measured by a single temperature sensor, or may be configured to be measured by two or more temperature sensors cooperatively.

In addition, the storage compartment 12, 13 may include a door 12*a*, 13*a*.

The door 12*a*, 13*a* serves to open and close the storage compartment 12, 13, and may have a rotatable opening and closing structure, and may have a drawer-type opening and closing structure.

The door 12*a*, 13*a* may be provided in one or more doors. In particular, at least any one of the door 12*a*, 13*a* or the casing 11 may be provided with a detection sensor 14 capable of detecting whether the door 12*a* and 13*a* are opened.

Next, the refrigerator 1 according to the embodiment of the present disclosure includes a cooling source.

The cooling source is configured to generate cold air.

Such a cooling source may be configured in various ways.

For example, the cooling source may be composed of a thermoelectric module 23.

In this case, the thermoelectric module 23 may include a thermoelectric element 23*a* including a heat absorbing surface 231 and a heat generating surface 232, and a sink 23*b* connected to at least one of the heat absorbing surface 231 and the heat generating surface 232, as shown in FIG. 3.

In addition, the cooling source may be composed of evaporators 21, 22.

The evaporators 21, 22 form a refrigeration system with a compressor 60 (see attached FIG. 4), a condenser (not shown), and an expander (not shown), and operate to lower the temperature of the air while exchanging heat with air passing through the evaporator.

When the storage compartment includes the first storage compartment 12 and the second storage compartment 13, the evaporator may include the first evaporator 21 for supplying cold air to the first storage compartment 12 and the second evaporator 22 for supplying cold air to the second storage compartment 13.

In this case, the first evaporator 21 may be located at a rear side of the first storage compartment 12 in the inner case 11*a*, and the second evaporator 22 may be located at a rear side of the second storage compartment 13.

Although not shown, the evaporator may be provided only in at least one of the first storage compartment 12 or the second storage compartment 13.

In addition, even if the two evaporators 21 and 22 are provided, only one compressor 60 constituting the corresponding refrigeration system may be provided.

In this case, as shown in FIG. 4, the compressor 60 may be connected to supply the refrigerant to the first evaporator 21 through a first refrigerant passage 61 and may be connected to supply the refrigerant to the second evaporator 22 through a second refrigerant passage 62. In this case, each of the refrigerant passages 61 and 62 may be selectively opened and closed using a refrigerant valve 63.

Next, the refrigerator 1 according to the embodiment of the present disclosure includes a cooling power control means.

The cooling power control means is a configuration provided to adjust the cooling power of the cold air supplied to the first storage compartment 12.

The cooling power control means may be configured to enable to load control by a controller 70, and the cooling power control means may include at least one of the compressor 60 and a first cooling fan 31.

Here, the compressor 60 is one of the components constituting the refrigeration system with the cooling sources (evaporator) 21 and 22, and cooling power may be adjusted by controlling the load of the compressor 60.

In addition, the first cooling fan 31 is a device that supplies cold air generated while passing through the first evaporator 21 to the first storage compartment 12, and cooling power may be adjusted through load control (controlling the rotation speed) of the first cooling fan 31.

Of course, the refrigerator may further include a second cooling fan 41 that supplies cold air generated while passing through the second evaporator 22 to the second storage compartment 13, or the first cooling fan 31 (or the second cooling fan) may be configured to supply cold air generated while passing through the first evaporator 21 or the second evaporator 22 to the second storage compartment 13.

Next, the refrigerator 1 according to the embodiment of the present disclosure includes a controller 70. The controller 70 may be a microprocessor, an electrical logical circuit, and the like.

The controller 70 may be configured to control the load and operation of the cooling power control means 41 and 60. That is, the controller 70 controls the first storage compartment 12 to maintain the first set notch temperature (NT) while controlling the load and operation of the cooling power control means 41 and 60 based on the temperature measured by the first temperature sensor 1*a* and the second temperature sensor 1*b*.

Based on the first set notch temperature (NT), a temperature range between the first upper limit notch temperature (NT+diff) and the first lower limit notch temperature (NT−diff) may be set as the satisfaction region. A temperature higher than the first upper limit notch temperature (NT+diff) may be set as a dissatisfaction region.

The controller 70 may differently control the load of the cooling power control means (compressor or first cooling fan) according to the normal storage operation and the load operation.

For example, during the normal storage operation, the temperature of the first storage compartment 12 may be controlled to gradually lower while operating in a power saving operation considering the power consumption of the cooling power control means (compressor or first cooling fan).

Meanwhile, during load operation, the cooling power control means (compressor or first cooling fan) may be controlled to operate at a higher load than in normal storage operation, and the temperature of the first storage compartment 12 may be quickly lowered in order to prevent food deterioration.

In addition, the controller may be configured such that the load operation is performed only when a start condition of the load operation is satisfied.

In addition, the controller 70 may check a termination condition of the load operation while the load operation is being performed, and may control the load operation to be terminated when the termination condition is satisfied.

In addition, when the first door 12*a* is re-opened while the load operation is being performed, the controller 70 may control the load operation to be performed while operating the cooling power control means (compressor or the first cooling fan) at the maximum load. That is, when the first door 12*a* is re-opened during the load operation, the maximum cooling power may be provided when the first door 12*a* is closed regardless of whether the operation start condition is satisfied. At this time, the maximum load is a load sufficient to provide a higher cooling power than the cooling power during the normal storage operation.

Of course, the supply of the maximum cooling power described above is performed until a predetermined time elapses after the load operation is re-performed, and thereafter, it is more preferable to control the cooling power to be varied according to the temperature in the first storage compartment 12.

In addition, the controller 70 controls the load operation to be stopped and a pre-defrosting operation for a defrosting operation to be preferentially performed when an input condition of the defrosting operation is satisfied while the load operation is being performed.

In particular, the pre-defrosting operation may control the cooling power control means (compressor and first cooling fan) to be operated at the maximum load until the compartment temperature (CT) in the first storage compartment 12 reaches a defrosting temperature. The defrosting temperature may be lower than the first lower limit notch temperature (NT−diff).

The control of the controller 70 is to minimize the time until the defrosting temperature is reached even when the compartment temperature is in the temperature range of the first upper limit notch temperature (NT+diff) or higher.

In addition, the controller 70 performs the defrosting operation after the pre-defrosting operation is completed.

After the defrosting operation is completed, the controller 70 may control the cooling power control means at the maximum load until the compartment temperature (CT) in the first compartment 12 reaches a temperature lower than the first set notch temperature (NT).

Next, a control method for the normal storage operation and the load operation of the refrigerator according to an embodiment of the present disclosure will be described in more detail with reference to the accompanying flowcharts of FIGS. 6 and 7.

Prior to the description, each operation is performed under the control of the controller 70 which receives a sensing value of each temperature sensor (1*a*,1*b*) and operates the refrigeration system, and in the following embodiment is an example of each operation for the first storage compartment 12.

First, as shown in the flowchart of FIG. 6, the controller 70 continuously acquires a sensing value at S110 for the room temperature outside the refrigerator and the temperature of the first storage compartment 12.

The temperature of the first storage compartment is measured by the second temperature sensor 1*b* located in the first storage compartment 12, and the measured temperature is provided to the controller 70.

The controller 70 continuously performs the normal storage operation for the first storage compartment 12 at S210, while controlling the cooling power control means based on the acquired the temperature in the first storage compartment.

The normal storage operation is performed to maintain the temperature range of the satisfaction region (temperature range between the first upper limit notch temperature (NT+diff) and the first lower limit notch temperature (NT−diff) based on the first set notch temperature (NT).

134. In this case, during the normal storage operation, the compressor 60 constituting the refrigeration system is controlled to operate at a lower output than the load operation.

In addition, in the normal storage operation, when the first upper limit notch temperature (NT+diff) is reached, the compressor 60 is operated to increase the supply of cold air. Before the first lower limit notch temperature (NT−diff) is reached, the operation of the compressor 60 is stopped to reduce the supply of cold air, and this operation is continuously repeated.

Of course, the compressor 60 may be controlled to operate before reaching the first upper limit notch temperature (NT+diff), or may be controlled to operate when reaching the dissatisfaction region exceeding the first upper limit notch temperature (NT+diff).

Also, while the normal storage operation is being performed, the controller 70 continuously checks whether the first door 12*a* is opened.

If the first door 12*a* is opened while the normal storage operation is being performed, the controller 70 checks whether the start condition for the load operation is satisfied at S130.

In this case, the opening of the first door 12*a* may include when the first door 12*a* is opened or when the first door 12*a* is opened and then closed. That is, only when the first door 12*a* opening and closing the first storage compartment 12 is opened, a determination on the start condition of the load operation is made. When the first door 12*a* is not opened, the normal storage operation is repeatedly performed.

Such a start condition of the load operation may include a condition of a set elapsed time (a first operation condition).

The condition of the set elapsed time may be from the time the first door 12*a* is opened until the set elapsed time is reached. That is, it may be set to periodically perform the determination of the condition within the set elapsed time. To this end, the controller 70 may include a counter 71 for counting time.

Of course, the condition for the set elapsed time may be after the set time is elapsed from the time point of opening the first door 12*a*. That is, it may be set to perform the determination of the condition after the set elapsed time has elapsed.

In addition, the start condition of the load operation may include a condition (a second operation condition) in which the temperature in the first storage compartment 12 measured after the first door 12*a* is opened exceeds an input temperature range (Δt).

The input temperature range (Δt) may be a specific temperature or a specific temperature range.

Preferably, the input temperature range (Δt) is a temperature that satisfies the condition of $0<\Delta t1\leq$a set upper limit temperature−the first upper limit notch temperature (NT+diff). In this case, the set upper limit temperature is the maximum temperature that the first storage compartment 12 of the refrigerator may allow, and may be a notch temperature for determining whether or not there is a malfunction or frost of the evaporator (first evaporator) 21. That is, the input temperature range (Δt) is determined so that the temperature of the first storage compartment does not exceed the set upper limit temperature.

In addition, the input temperature range (Δt) may be different from a case where the temperature measured when the first door 12*a* is opened is higher than the first upper limit notch temperature (NT+diff) set based on the first set notch temperature (NT) and a case where the temperature is lower than the first upper limit notch temperature (NT+diff).

In addition, the start condition of the load operation may include a case where the compartment temperature (CT) of the first storage compartment is greater than or equal to the base value (CT≥base value 1) (a third operation condition).

Here, the base value 1 is greater than the first upper limit notch temperature (NT+diff) and less than or equal to the set upper limit temperature ((NT+diff)<base value 1≤set upper limit temperature).

That is, the third operation condition is a condition that supplements the first and second operation conditions, and if the first door 12*a* is opened and the compartment temperature (CT) of the storage compartment belongs to the dissatisfaction region (higher than the first upper limit notch temperature (NT+diff)), the load operation is performed regardless of the input temperature range (Δt) or the elapsed time after the first door 12*a* is opened.

In addition, the start condition of the load operation may include a case where a base value 2 is less than the input temperature range (Δt) (Δt>the base value 2). In this case, the base value 2 is greater than 0 but smaller than or equal to the difference between the first upper limit notch temperature (NT+diff) from the set upper limit temperature (0<base value 2≤set upper limit temperature−first upper limit notch temperature (NT+diff)).

In other words, after the first door 12*a* is opened, when the input temperature range (Δt) is set to fall within the temperature between the set upper limit temperature and the first upper limit notch temperature (NT+diff), the load operation is performed regardless of whether the input temperature range (Δt) is reached.

Meanwhile, the load operation may be performed even if only one of the aforementioned operation start conditions is satisfied, or the load operation may be performed only when two or more conditions are simultaneously satisfied.

When it is determined that the start condition of the load operation is satisfied (when the temperature in the storage compartment is within the dissatisfaction region, or when the temperature rise in the storage compartment is greater than or equal to the input temperature range (Δt) even in the satisfaction region), the controller 70 controls the load operation to be performed at S140 according to the result of this determination.

Of course, the load operation is controlled to perform when the temperature rises above the input condition temperature (Δt) set in advance for a predetermined time regardless of the temperature region in the first storage compartment 12, as in a method known in the prior art.

In this case, the load operation may be performed in a state in which the first door 12*a* is closed.

That is, when it is determined that the start condition of the load operation is satisfied before the first door 12*a* is closed, the load operation may be performed immediately after the first door 12*a* is closed. When it is determined that the start condition of the load operation is satisfied after the first door 12*a* is closed, the load operation may be performed immediately after the determination is made.

In addition, the load operation is performed while providing a higher cooling power than that of the normal storage operation. In this case, the cooling power control means may be operated at the maximum load until the end of the operation, or the load may be varied depending on the temperature region in the first storage compartment 12 after being operated at the maximum load at the beginning of the operation, or the load may be varied depending on the temperature region in the first storage compartment 12 from the beginning of the load operation.

If the first door 12*a* is reopened while the load operation is being performed, the controller 70 operates the cooling power control means (compressor or first cooling fan) at the maximum load and controls the load operation to be performed. Accordingly, the time required to reconfirm the operation start condition of the load operation may be reduced.

The above-described maximum cooling power is provided until a predetermined time elapses after the load operation is performed again. When this time elapses, the cooling power is controlled to vary according to the temperature of the storage compartment 12.

If the input condition of the defrosting operation is satisfied while the load operation is being performed, the controller 70 stops (or forcibly ends) the load operation and controls the pre-defrosting operation for the defrosting operation to be preferentially performed.

That is, the controller 70 controls the cooling power control means (compressor or first cooling fan) to operate at the maximum load and cools until the compartment temperature (CT) of the storage compartment 12 reaches a defrosting performance temperature lower than the first lower limit notch temperature (NT−diff). Accordingly, even when the temperature of the storage compartment is the first upper limit notch temperature (NT+diff) or higher, the time until reaching the defrosting performance temperature may be minimized.

When the pre-defrosting operation is completed, the controller 70 performs the defrosting operation. The defrosting operation heats the first evaporator 21 by providing hot air, and blows air through the first evaporator 21 by the operation of the first cooling fan 31 so that the frost formed on the surface of the first evaporator 21 is melted.

When the defrosting operation is completed, the controller 70 stops providing hot air, and operates the cooling power control means (compressor and first cooling fan) with the maximum load to cool the temperature of the storage compartment 12 until it reaches a temperature lower than the first set notch temperature (NT).

Thereafter, the controller 70 controls the temperature of the storage compartment 12 to maintain the satisfaction region (the temperature range between the first upper limit notch temperature (NT+diff) and the first lower limit notch temperature (NT−diff)), while performing the normal storage operation.

Meanwhile, the controller 70 continuously checks whether or not the termination condition of the load operation is satisfied at S150 while performing the control for the load operation.

In the prior art (for example, Korean Patent No. 10-2018-0055242), the load operation is terminated when a set time or a set temperature is reached under an operation termination condition.

The operation termination conditions of the prior art have problems of overcooling and degradation of power consumption.

Accordingly, the embodiment of the present disclosure provides at least one or more termination conditions of the load operation in which power consumption may be improved.

The termination condition of the load operation may include a case where the temperature of the first storage compartment 12 reaches a set lowest temperature (LNT) which may be settable after the load operation is performed by satisfying the start condition of the load operation.

Specifically, after the load operation is performed, when it is confirmed that the temperature of the first storage compartment 12 reaches the set lowest temperature (LNT) at S151, it is determined that the termination condition is satisfied, and the load operation is terminated.

In this case, the set lowest temperature (LNT) is a temperature lower than the first lower limit notch temperature (NT−diff) and higher than 0° C. It is the lowest temperature that may be set by a user.

That is, in the case of the first storage compartment 12 used for refrigerating the stored items, the set lowest temperature (LNT) is higher than 0° C. This prevents the compartment temperature (CT) in the first storage compartment 12 from falling below 0° C. and overcooling the stored items.

The control related this is as shown in the flowchart of FIG. 7.

In addition, the termination condition may include a condition at S152 that the compartment temperature (CT) of the first storage compartment 12 belongs to the satisfaction region due to the load operation when the load operation starts in the dissatisfaction region.

That is, when the load operation starts in the dissatisfaction region of the compartment temperature (CT) of the first storage compartment 12, the compartment temperature (CT) of the first storage compartment 12 is checked at S152*a*. In addition, when the checked compartment temperature (CT) is within the satisfaction region, it is determined that the termination condition of the load operation is satisfied at S152*b*. When the termination condition is satisfied in this way, the load operation may be controlled to be terminated. In this case, the dissatisfaction region is a temperature region higher than the first upper limit notch temperature (NT+diff) set based on the first set notch temperature (NT). The satisfaction region is a temperature region between the first upper limit notch temperature (NT+diff) and the first lower limit notch temperature (NT−diff).

The control related this is as shown in the flowchart of FIG. 8.

In addition, when the load operation starts in the dissatisfaction region of the compartment temperature (CT) of the first storage compartment 12, the termination condition may include a condition at S153 in which the compartment temperature (CT) in the first storage compartment 12 falls below the start temperature (CT_S) checked when the load operation starts.

That is, when the load operation starts in the dissatisfaction region of high compartment temperature (CT) in the first storage compartment 12, the start temperature (CT_S) of the load operation is checked at S153*a*. After the load operation is performed, the compartment temperature (CT) of the first storage compartment 12 is checked at S153*b* to determine that the compartment temperature (CT) falls below the start temperature (CT_S).

When the compartment temperature (CT) falls below the start temperature (CT_S), it is determined that the termination condition is satisfied at S153*c* and the load operation is controlled to be terminated.

The control related this is as shown in the flowchart of FIG. 9.

Of course, even if the load operation starts while the temperature of the first storage compartment 12 is not in the dissatisfaction region, when the compartment temperature (CT) of the first storage compartment 12 falls below the start temperature (CT_S) at which the load operation starts, it is determined that the termination condition is satisfied and the load operation may be terminated.

In addition, the termination condition may include a condition at S154 determined according to a temperature change amount (ΔT) per unit time in the first storage compartment 12 after the load operation starts, when the load operation starts in the dissatisfaction region of the compartment temperature (CT) of the first storage compartment 12.

That is, when the load operation starts in the dissatisfaction region where the temperature in the first storage compartment 12 is higher than the first upper limit notch temperature (NT+diff) set based on the first set notch temperature (NT), the temperature change amount (ΔT) falling per unit time of the first storage compartment 12 is checked at 154*a* after the load operation starts. When the temperature change amount (ΔT) is greater than a preset change amount, it is determined that the termination condition is satisfied at S154*b* and the load operation is terminated.

The control related this is as shown in the flowchart of FIG. 10.

In addition, the termination condition may include a condition at S155 in which the compartment temperature (CT) in the first storage compartment 12 during the load operation falls below the start temperature (CT_S) in the first storage compartment 12 checked at the start of the load operation.

That is, when the load operation is performed by satisfying the start condition, the temperature (CT_S) in the first storage compartment 12 at the start of the load operation is checked at S155*a* and stored. While the load operation is being performed, the compartment temperature (CT) of the first storage compartment 12, which is changed in real time, is checked at S155*b*. When the compartment temperature (CT) is lower than the start temperature (CT_S) stored at the starting point, it is determined that the termination condition is satisfied at S155*c* and the load operation is terminated.

In this case, in the termination condition, it is preferable that the confirmation of the compartment temperature (CT) in the first storage compartment 12 is not performed from the start of the load operation, but is performed when the set elapsed time elapses after the load operation is performed.

The control related this is as shown in the flowchart of FIG. 11.

In addition, the termination condition may include a condition at S156 in which a time taken for the compartment temperature (CT) of the first storage compartment 12 to reach any one of a plurality of set temperatures during the load operation is shorter than a preset arrival time for each corresponding temperature.

That is, when the start condition of the load operation is satisfied and the load operation is performed, the compartment temperature (CT) of the first storage compartment 12 is checked at S156*a*, and time (T1, T2, T3) at which the compartment temperature (CT) reaches any one of a plurality of set temperatures is checked at S156*b*, 156*c*, 156*d*. When it is confirmed that the confirmed arrival time (T1, T2, T3) is shorter than the preset arrival time (set time 1, set time 2, set time 3) for each corresponding temperature, it is determined (S156*e*) that the termination condition of the load operation is satisfied, so that the load operation is terminated.

Here, each of the set temperatures may include the upper notch temperature (NT+diff), the set notch temperature (NT), and the lower notch temperature (NT−diff).

For example, when the time taken for the compartment temperature (CT) of the first storage compartment 12 to reach the upper limit notch temperature (NT+diff) is shorter than the set time 1 (e.g., 5 minutes), when the time taken for the compartment temperature (CT) to reach the set notch temperature (NT) is shorter than the set time 2 (e.g., 10 minutes), or when the time taken for the compartment temperature (CT) to reach the lower limit notch temperature (NT−diff) is shorter than the set time 3 (e.g., 15 minutes), the load operation is terminated.

On the other hand, if the time (T1, T2, T3) taken for the compartment temperature (CT) of the first storage compartment 12 to reach a plurality of set temperatures is longer than the preset arrival time (set time 1, set time 2, set time 3) for each temperature, it is determined that the termination condition is not satisfied at S156*f* and the load operation continues.

The control related this is as shown in the flowchart of FIG. 12.

Meanwhile, at least one of the above-described termination conditions of the load operation may be controlled to be differently set according to the temperature change amount (ΔT) per unit time of the compartment temperature (CT) of the first storage compartment 12 while the load operation is being performed.

196. For example, the termination condition of the load operation may include a case where a termination time of the load operation is reached. In this case, as the temperature change amount (ΔT) per unit time becomes greater, the termination time of the load operation is controlled to be shortened. On the other hand, as the temperature change amount (ΔT) per unit time becomes smaller, the termination time of the load operation is controlled to be longer.

In addition, the termination condition includes a case where a termination temperature of the load operation is reached. In this case, as the temperature change amount (ΔT) per unit time becomes greater, the termination temperature of the load operation is controlled to be higher. On the other hand, as the temperature change amount (ΔT) per unit time becomes smaller, the termination temperature of the load operation is controlled to be lower.

In this case, the temperature change amount (ΔT) per unit time is measured when the compartment temperature (CT) of the first storage compartment 12 reaches the upper limit notch temperature (NT+diff) set based on the set notch temperature (NT). That is, only when the compartment temperature (CT) of the first storage compartment 12 belongs to the satisfaction region, the load operation may be terminated according to the temperature change amount (ΔT) per unit time.

When the load operation is terminated by the control of the controller 70 due to the satisfaction of the termination condition, the controller 70 performs the normal storage operation while controlling the cooling power control means (compressor and the first cooling fan) based on the compartment temperature (CT) of the first storage compartment 12.

As described above, when the temperature in the first storage compartment 12 reaches the set lowest temperature (LNT) while the load operation is being performed, the load operation is terminated. Therefore, the refrigerator and the control method thereof the present disclosure may prevent undesirably freezing the stored items due to excessive cooling.

In addition, in the refrigerator and control method thereof of the present disclosure, when the load operation starts in the temperature dissatisfaction region in the storage compartment, the load operation is terminated when the temperature of the storage compartment belongs to the satisfaction region, thereby reducing power consumption for the load operation.

In addition, in the refrigerator and control method thereof of the present disclosure, when the load operation starts in the temperature dissatisfaction region in the storage compartment, when the compartment temperature (CT) of the storage compartment is lower than the start temperature of the load operation, the load operation is terminated, thereby reducing power consumption for the load operation.

In addition, in the refrigerator and control method thereof of the present disclosure, after the load operation is performed, when the compartment temperature (CT) of the storage compartment falls below the temperature when the load operation starts, the load operation is terminated, thereby reducing power consumption for the load operation.

In addition, in the refrigerator and control method thereof of the present disclosure, if the time taken for the compartment temperature (CT) of the storage compartment to reach any one of a plurality of set temperatures during the load operation is shorter than the preset arrival time for each temperature, the load operation is terminated. Therefore, the load operation due to the door opening is performed accurately and the power consumption for the load operation may be reduced.

In addition, in the refrigerator and control method thereof of the present disclosure, as the temperature change amount (ΔT) per unit time of the compartment temperature (CT) of the storage compartment becomes greater during the load operation, the termination time of the load operation is shortened, and power consumption for the load operation is reduced.

The invention claimed is:

1. A control method of a refrigerator, the method comprising:

a temperature measurement step of measuring a temperature in a storage compartment;

a door open confirmation step of confirming whether a door is open;

a start condition determination step of determining whether or not a start condition for a load operation is satisfied based on the temperature in the storage compartment;

a performing operation step of performing the load operation in response to the start condition of the load operation being satisfied, wherein a temperature in the storage compartment is checked at the start of the load operation and stored;

a termination condition determination step of determining whether or not a termination condition of the load operation is satisfied based on the temperature in the storage compartment; and an operation termination step of terminating the load operation in response to the termination condition of the load operation being satisfied, wherein the termination condition of the load operation is determined to be satisfied in response to the temperature in the storage compartment checked during the load operation falls lower than the stored temperature in the storage compartment checked at the start of the load operation.

2. The method of claim 1, wherein the checking of the temperature in the storage compartment in the termination condition of the load operation is performed based on a set elapsed time having elapsed since the load operation started.

3. The method of claim 2, wherein the start condition of the load operation is determined to be satisfied based on the temperature in the storage compartment rising to exceed an input condition temperature (Δt) during a set time, and wherein the set elapsed time for the termination of the load operation is shorter than the set time for the start condition of the load operation.

4. The method of claim 1, wherein based on the load operation starting in a dissatisfaction region where the temperature in the storage compartment is higher than an upper limit notch temperature (NT+diff) set based on a set notch temperature (NT), the termination condition of the load operation includes a condition in which the temperature in the storage compartment is in a satisfaction region between the upper limit notch temperature (NT+diff) and a lower limit notch temperature (NT−diff) set based on the set notch temperature (NT).

5. A control method of a refrigerator, the method comprising:

a temperature measurement step of measuring a temperature in a storage compartment;

a door open confirmation step of confirming whether a door is open;

a start condition determination step of determining whether or not a start condition for a load operation is satisfied based on the temperature in the storage compartment;

a performing operation step of performing the load operation in response to the start condition of the load operation being satisfied, wherein, during the load operation, a temperature change amount (ΔT) per unit time of the temperature in the storage compartment is measured in response to the temperature in the storage compartment reaching an upper limit notch temperature (NT+diff) set based on a set notch temperature (NT);

a termination condition determination step of determining whether or not a termination condition of the load operation is satisfied based on the temperature in the storage compartment, wherein the termination condition of the load operation is controlled to be changed according to the temperature change amount (ΔT); and an operation termination step of terminating the load operation in response to the termination condition of the load operation being satisfied.

6. The method of claim 5, wherein the termination condition of the load operation includes a case where a termination time of the load operation is reached, wherein, as the temperature change amount (ΔT) per unit time becomes greater, the termination time of the load operation is controlled to be shortened, and as the temperature change amount (ΔT) per unit time becomes smaller, the termination time of the load operation is controlled to be longer.

7. The method of claim 5, wherein the termination condition of the load operation includes a case where a termination temperature of the load operation is reached, wherein, as the temperature change amount (ΔT) per unit time becomes greater, the termination temperature of the load operation is controlled to be higher, and as the temperature change amount (ΔT) per unit time becomes smaller, the termination temperature of the load operation is controlled to be lower.

* * * * *